US005702589A

United States Patent [19]

Tsang et al.

[11] Patent Number: 5,702,589

[45] Date of Patent: Dec. 30, 1997

[54] PROCESS FOR CONVERTING OLEFINIC HYDROCARBONS USING SPENT FCC CATALYST

[75] Inventors: Chih-Hao Mark Tsang, Houston; Randall Hughes Petty, Port Neches; Glenn Allen Clausen, Port Arthur; Charles Henry Schrader, Groves, all of Tex.

[73] Assignee: ABB Lummus Global Inc., Bloomfield, N.J.

[21] Appl. No.: 674,963

[22] Filed: Jul. 3, 1996

Related U.S. Application Data

[63] Continuation of Ser. No. 429,973, Apr. 27, 1995, abandoned.

[51] Int. Cl.[6] ..... C10G 51/02

[52] U.S. Cl. ..... 208/67; 208/49; 208/71; 208/149; 208/150; 208/164; 208/147; 585/330

[58] Field of Search ..... 208/78, 67, 49, 208/71, 150, 147, 149

[56] References Cited

U.S. PATENT DOCUMENTS

| | | | |
|---|---|---|---|
| 3,843,510 | 10/1974 | Morrison et al. | 208/111 |
| 3,856,659 | 12/1974 | Owen | 208/80 |
| 3,894,934 | 7/1975 | Owen et al. | 208/78 |
| 3,894,935 | 7/1975 | Owen | 208/78 |
| 4,552,644 | 11/1985 | Johnson et al. | 208/78 |
| 4,552,645 | 11/1985 | Gartside | 208/78 |
| 4,906,442 | 3/1990 | Johnson | 208/72 |
| 5,164,071 | 11/1992 | Harandi | 208/67 |
| 5,372,704 | 12/1994 | Hazandi et al. | 208/74 |

*Primary Examiner*—Helane Myers

*Attorney, Agent, or Firm*—Alix, Yale & Ristas, LLP

[57] ABSTRACT

Disclosed is a process for converting olefinic hydrocarbons using spent FCC catalysts which comprises using spent FCC catalysts, optionally containing spent FCC additives, in the reactor/stripper part of the FCCU, instead of or in addition to a separate olefin upgrader, to upgrade $C_2$–$C_8$ oligomerizable olefins, preferably propylene and ethylene, into $C_4$/$C_5$ olefins and isoparaffins as well as gasoline, wherein feedstock can be product streams of the FCCU containing propylene/ethylene such as, for example, the absorber and depropanizer overheads.

10 Claims, 1 Drawing Sheet

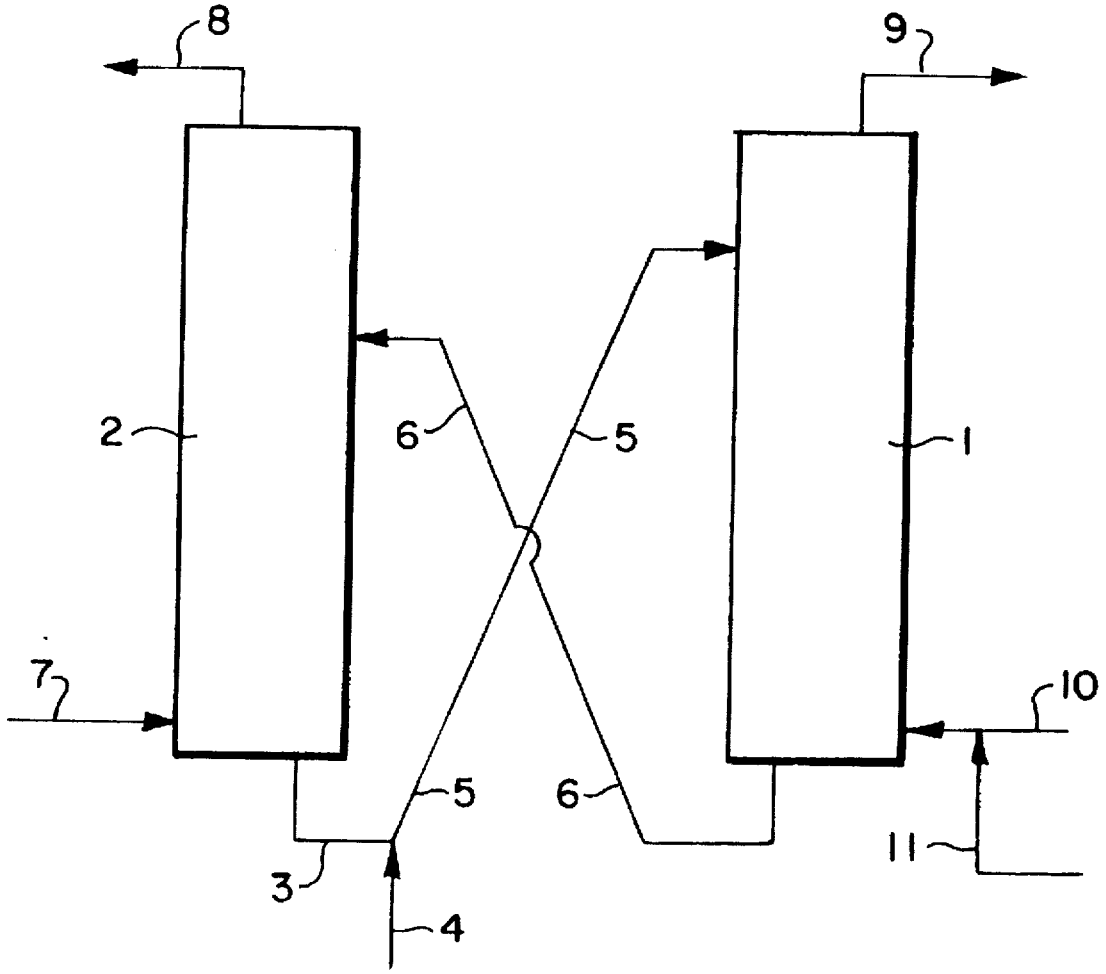
8
9
2
6
5
1
7
10
5
6
11
3
4

PROCESS FOR CONVERTING OLEFINIC HYDROCARBONS USING SPENT FCC CATALYST

This is a continuation of application Ser. No. 08/429,973 now abandoned, filed on Apr. 27, 1995.

FIELD OF THE INVENTION

This invention relates to a process for using the spent FCC catalysts circulated into the FCC reactor/stripper during routine FCCU operation to promote the conversion of olefinic hydrocarbons. Particularly it relates to a process for upgrading oligomerizable olefins into essential feedstock for alkylation and ether units as well as gasoline.

More particularly, it relates to a catalytic process for upgrading oligomerizable $C_2$ to $C_8$ olefins in the FCCU reactor/stripper to essential feedstock for alkylation and ether units containing isobutane, butenes and isoamylenes. Gasoline may also be a product of this olefin upgrading process. Products from this invention and from the FCCU are combined and handled by the existing equipment. No additional catalyst or reactor other than those already available in typical FCCU operations is required.

BACKGROUND OF THE INVENTION

Catalytic cracking is routinely used to convert heavy petroleum fractions to lighter products and fluidized catalytic cracking is particularly advantageous. The heavy feed contacts hot regenerated catalysts and is cracked to lighter products.

In most modern FCC units the hot regenerated catalyst is added to the feed at the base of the riser reactor. The fluidization of the solid catalyst particles may be promoted with a lift gas.

Steam can be used in an amount equal to about 1–5 wt % of the hydrocarbon feed to promote mixing and atomization of the feedstock. Preheated charge stock (150°–375° C.) is mixed with hot catalyst (650° C.$^+$) from the regenerator. The catalyst vaporizes and super heats the feed to the desired cracking temperature, usually 450°–600° C. During the upward passage of the catalyst and feed, the feed is cracked and coke deposits on the catalyst. The cracked products and coked catalyst exit the riser and enter a solid-gas separation system, e.g., a series of cyclones, at the top of the reactor vessel. The cracked hydrocarbon products are typically fractionated into a series of products, including gas, gasoline, light gas oil and heavy cycle gas oil. Some heavy cycle gas oil may be recycled to the reactor. The bottoms product, a "slurry oil", is conventionally allowed to settle. The solids portion of the settled product rich in catalyst particles may be recycled to the reactor.

The following references, which contain good overviews of FCC processes are incorporated herein by reference: U.S. Pat. Nos. 3,152,065 (Sharp et al.); 3,261,776 (Banman et al.); 3,654,140 (Griffel et al.); 3,812,029 (Snyder); 4,093,537; 4,118,337; 4,118,338; 4,218,306 (Gross et al.); 4,444,722 (Owen); 4,459,203 (Beech et al.); 4,639,308 (Lee); 4,675,099; 4,681,743 (Skraba) as well as in Venuto et al., Fluid Catalytic Cracking With Zeolite Catalysts, Marcel Dekker, Inc. (1979).

The FCC octane barrel catalyst (i.e. a catalyst which permits attainment of both octane number and gasoline yield) typically contains ultrastable Y-zeolites or dealuminated Y-zeolites. The ultrastable Y-zeolite is generally obtained by hydrothermal or thermal treatment of the ammonium or hydrogen form of the Y-type zeolite at temperatures above 1000° F. in the presence of steam. Ultrastabilization by hydrothermal treatment was first described by Maher and McDaniel in the U.S. Pat. No. 3,374,056. U.S. Pat. No. 3,449,070 to McDaniel et al. discloses a method of producing an ultrastable Y-zeolite by ion exchanging a charge faujasite zeolite to reduce the alkali metal content. The Unit Cell Size of the product is 24.40 Å–24.55 Å. Ammonium exchange and a second hydrothermal treatment at a temperature of about 1300° F. to 1900° F. further reduces the Unit Cell Size down to 24.20 Å to 24.45 Å. Hydrothermal treatment removes tetrahedral aluminum from the framework but not from the zeolite cages or channels where it remains as a hydrated cation or an amorphous oxide.

Commonly used FCC base catalysts include finely divided acidic zeolites such as, for example, Rare-Earth Y (REY), Dealuminated Y (DAY), Ultrastable Y (USY), Rare-Earth Containing Ultrastable Y (RE-USY) and Ultrahydrophobic Y (UHP-Y). The FCC catalysts are typically fine particles having particle diameters ranging from about 20 to 150 microns and an average diameter around 60–80 microns.

As is well-known to those skilled in the art, the advent of reformulated gasolines to meet ever increasing environmental and other requirements is reflected in a significant increase in the demand for isobutylene and isoamylenes which are used to prepare methyl t-butyl ether (MTBE) and t-amyl methyl ether (TAME)—the gasoline additives of significant current interest. Isobutane and n-butenes are also of increasing importance due to the high octane alkylates that can be produced from them.

On the other hand, there are abundant supplies of propylene and ethylene which are available from refining processes such as catalytic cracking. It would be desirable to be able to convert these propylene ($C_3^=$) and ethylene ($C_2^=$) streams to isobutane (i-$C_4$), n-butenes (n-$C_4^=$), isobutylene (i-$C_4^=$), isoamylenes (i-$C_5^=$), as well as gasoline streams.

U.S. Pat. No. 5,164,071 discloses the integration of an olefin upgrading reactor using ZSM-5 or ZSM-23 with FCCU. The disclosure was limited to ZSM-5 and ZSM-23 and no data were given.

U.S. Pat. No. 4,465,884 teaches a process of converting $C_{3+}$ olefins to product comprising non-aromatic hydrocarbons of higher molecular weight than feedstock olefins and aromatic hydrocarbons using large pore Y and beta zeolites. Butenes, isoamylenes and isobutane were not the products of interest.

U.S. Pat. Nos 4,957,709 and 4,886,925 teach a system combining olefin interconversion (upgrading olefins into streams rich in isobutylene and isoamylene with the production of MTBE and TAME). Here olefin upgrading units were integrated with etherification units rather than FCC units.

U.S. Pat. No. 5,146,029 teaches olefin interconversion by MCM-22 zeolite. The application is limited solely to the MCM-22.

U.S. Pat. Nos. 5,134,241 and 5,134,242 teach olefin upgrading using the MCM-41 zeolite.

U.S. Pat. No. 4,899,014 discloses olefin upgrading using ZSM-5, however the upgrading is mainly for gasoline production.

U.S. Pat. No. 4,556,753 teaches upgrading propylene to isobutene using silicalite zeolites in the presence of steam, however isoamylenes were not included.

U.S. Pat. No. 4,527,001 discloses small olefin interconversions using metal phosphate molecular sieves, such as, for example, AlPO, SAPO, FeAPO and CoAPO, however isoamylenes were not included.

Since the introduction of reformulated gasoline, refiners have investigated ways to produce the ether and alkylate components needed to meet the composition requirements. In a refinery, the FCC unit is a major source for alkylate/ether precursors, namely, isobutane, butenes, and pentenes. In order to further boost the yield of these light gases, the FCCU can be operated in an overcracking mode or additives containing ZSM-5 can be used in the circulating FCCU catalyst inventory. Inevitably, propylene and ethylene yields increase as well. The value of propylene and ethylene to the refinery depends on the available outlets. Excess propylene and ethylene are sometimes burned as fuel gas with minimal value.

Copending Ser. No. 08/257,994 (92043) discloses a process using acid catalysts to upgrade oligomerizable olefins into a product stream containing $C_4/C_5$ olefins and isoparaffins. A separate upgrading reactor was required.

It would constitute a distinct advance in the field of refining if there were a method available for upgrading excess FCC propylene and ethylene into more useful isobutane, $C_4/C_5$ olefins, and gasoline, and enhancing the overall yield of alkylation and ether feedstock using existing equipment.

If this could be accomplished with existing equipment and without the necessity of a separate olefin upgrading reactor it would be substantial advantage with respect to cost.

STATEMENT OF THE INVENTION

In accordance with the foregoing, this invention comprises:

- a process for upgrading olefins and enhancing the overall yield of feedstock for alkylation/ether units as well as gasoline which does not require a separate olefin upgrading reactor which comprises:
- charging FCC feedstock to the FCC unit riser,
- charging regenerated FCC catalyst/additive to the FCC riser,
- Reacting said FCC feedstock over the catalyst/additive in the FCC riser to produce a hydrocarbon effluent,
- introducing said hydrocarbon effluent and spent FCC catalyst/additive into a reactor/stripper,
- separating said hydrocarbon products and spent catalyst/additive in the reactor/stripper,
- introducing a stream containing oligomerizable olefins to be upgraded to said stripper portion of the FCCU,
- reacting said oligomerizable olefins over spent FCC catalyst/additive in the stripper and the reactor to produce feedstock for alkylation/ether units as well as gasoline,
- simultaneously stripping said spent FCC catalyst/additive,
- combining the hydrocarbon effluent from the riser and the product stream from olefin upgrading in the reactor/stripper and directing said combined stream to a typical FCCU means of separation, and
- removing spent FCC catalyst/additive from the reactor/stripper, and circulating said spent catalyst/additive to the regenerator. The invention can be operated with existing equipment and catalysts.

BRIEF DESCRIPTION OF THE DRAWING

The drawing is a schematic diagram of the olefin upgrading process using spent FCC catalysts in a FCCU reactor/stripper.

DETAILED DESCRIPTION OF THE INVENTION

The improved process of this invention for enhanced production of alkylate/ether precursors in a catalytic cracking process will work in conventional FCC units processing conventional FCC feedstock using conventional FCC catalysts/additives. Typical FCC units are described for example, in U.S. Pat. No. 5,288,920 (79,433-D1); U.S. Pat. No. 5,362,380 (92047); as well as in Venuto et al., Fluid Catalytic Cracking with Zeolite Catalysts, Marcel Dekker, Inc. (1979) and Guide to Fluid Catalytic Cracking, Part One, Grace Davison (1993), all of which are incorporated by reference herein in their entirety.

FCC CATALYST

A typical FCC catalyst is prepared by mixing a Y-zeolite with a matrix and spray drying to form particles of 40–200 micron size.

The Y-zeolite may include a Y-zeolite selected from the group consisting of (i) ammonium form of dealuminated Y-zeolite having a silica-to-alumina mole ratio of 10–120, (ii) a hydrogen form of dealuminated Y-zeolite having a silica-to-alumina mole ratio of 10–120, (iii) a metal exchanged dealuminated Y-zeolite having a silica to alumina mole ratio of 10–120 and a lattice constant of about 24.30–24.50 Å, which charge is particularly characterized by the presence of secondary pores of diameter of about 100–600 Å.

Dealuminated Y-zeolites which may be employed may include ultrastable Y-zeolites, super ultrastable Y-zeolite, etc.

The charge zeolite may be preferably in the hydrogen form, the ammonium form, or in an exchanged form, i.e., a form in which any alkali metal present has been exchanged for, e.g., one or more rare-earth metals. Alkali metal is present preferably in amount of less than about 0.5 wt %. The preferred form is the commercial hydrogen form.

Suitable zeolites include: Zeolite L, Zeolite X, Zeolite Y, and preferably higher silica forms of zeolite Y such as Dealuminated Y (DAY Y; U.S. Pat. No. 3,442,795); Ultrastable Y (USY; U.S. Pat. No. 3,449,070), Ultrahydrophobic Y (UHP-Y U.S. Pat. Nos. 4,331,694; 4,401,556) and similar materials are preferred. Zeolite beta (U.S. Pat. No. 3,308,069) or Zeolite L (U.S. Pat. Nos. 3,216,789; 4,544,539; 4,554,146 and 4,701,315) may also be used. The cited patents describe preparation and are incorporated herein by reference. These materials may be subjected to conventional treatments, such as impregnation or ion exchange with rare-earths to increase stability.

These large-pore molecular sieves have a geometric pore opening of about 7 angstroms in diameter. In current commercial practice, most of the cracking of large molecules in the feed is done using these large pore molecular sieves with the help of matrix activity.

The properties of a typical base catalyst are set forth in the table which follows:

TYPICAL CHARGE ZEOLITES

TABLE I

| Properties of the Equilibrium Catalyst Used as the Base Catalyst | |
|---|---|
| $Al_2O_3$ | 35.4 wt % |
| $SiO_2$ | 59.1 wt % |
| $Na_2O$ | 0.47 wt % |
| Nickel | 270 ppm |
| Vanadium | 700 ppm |
| BET Surface Area | 153 $m^2/g$ |
| Pore Volume | 0.36 cc/g |
| Unit Cell Size | 24.31 Å |

A charge zeolite which provided good results as will be demonstrated in the Example was an RE-USY zeolite catalyst.

FCC ADDITIVES

Typical FCC additives may optionally be used in the instant invention, charged with the spent catalyst and used to upgrade olefins.

The additives in the instant invention comprise medium pore pentasil zeolites, including but not limited to ZSM-5. Pentasil zeolites are discussed in copending Ser. No. 08/239,052 at pages 14–16, incorporated herein by reference in its entirety.

FCC FEEDSTOCK

Hydrocarbon feedstocks which are subjected to fluid catalytic cracking are distillate fractions derived from crude petroleum. These fractions include any of the intermediate distillate fractions. These intermediate distillate fractions may generally be described as having an initial boiling point heavier than the end point of gasoline.

Within this general range are a number of preferred fractions for the process. These include naphtha, kerosene, diesel, gas oil and vacuum gas oil. The most preferred fractions for fluid catalytic cracking are the gas oil and vacuum gas oil fractions. Traditionally gasoline has a boiling range of $C_5$ or 90° F. (32° C.) to 430° F. (221° C.). Naphtha has a boiling range of 90° F. (32° C.) to 430° F. (221° C.). Kerosene has a boiling range of 360° F. (182° C.) to 530° F. (276° C.). Diesel has a boiling range of 360° F. (182° C.) to about 650° F.–680° F. (343°–360° C.). The end point for diesel is 650° F. (343° C.) in the United States and 680° F. (360° C.) in Europe. Gas oil has an initial boiling point of about 650° F. (343° C.) to 680° F. (360° C.) and an end point of about 800° F. (426° C.). The end point for gas oil is selected in view of process economics and product demand and is generally in the 750° F. (398° F.) to 800° F. (426° C.) range with 750° F. (398° C.) to 775° F. (412° C.) being most typical. Vacuum gas oil has an initial boiling point of 750° F. (398° C.) to 800° F. (426° C.) and an end point of 950° F. (510° C.) to 1100° F. (593° C.). The initial boiling point and end point are defined by the hydrocarbon component distribution in the fraction as determined by fractionation analyses, ASTM D-86 or ASTM D-1160. FCCU feedstock can also contain residuum material (material boiling in excess of 1100° F. (593° C.)). Residuum material is also called vacuum tower bottoms and usually contains large amounts of carbon residue (which forms coke in the FCCU) and metals such as Ni and V which deposit on the catalyst and additives and reduce overall activity. FCCU feedstock can also contain intermediate products from other refinery process units including but not limited to: coker light and heavy gas oils, visbreaker gas oils, deasphalted oil, or extracts from base oil production units.

The gas oil feedstock used in the examples has the following properties.

TABLE 2

| Properties of the Gas Oil Used in FCC-MAT. | |
|---|---|
| API Gravity | 21.4 |
| Pour Point | 91° F. |
| Aniline Point | 163° F. |
| Sulfur | 2.52 wt % |
| Vanadium | 4.4 ppm |
| Nickel | 4.1 ppm |

OLEFIN CHARGE

The charge stream which may be employed in practice of the process of this invention may be an oligomerizable olefin stream either pure or, as is more typical, admixed with other hydrocarbons. Although it may be possible to utilize higher olefins, it is found that these long chain olefins tend to crack before they oligomerize; and thus they are not desirable components of the charge stream. Cycloolefins (such as cyclohexene) and dienes (such as butadiene) are also undesirable components of the charge stream because they tend to coke.

Preferably the charge stream may be a $C_2$ to $C_8$ olefin, more preferably a stream containing propylene and ethylene. Although it is possible to utilize a charge stream containing 100% propylene or ethylene, it is more convenient to utilize refinery streams which contain other gases, as these are commonly obtained, e.g., as an off-gas from distillation of naphtha product from a fluid catalytic cracking unit, or an overhead stream from the primary absorber or the secondary absorber or depropanizer. A stream such as the secondary absorber overhead is typically of low value and often burned as fuel gas. The process of this invention can significantly upgrade its value. A typical gas of this type which may be used as charge may contain the following components, in volume or mol %:

TABLE 3

| Component | Broad | Preferred | Typical |
|---|---|---|---|
| Methane | 0–80 | 0–60 | 50 |
| Ethane | 0–80 | 0–50 | 20 |
| Ethylene | 0–100 | 1–80 | 20 |
| Propane | 0–80 | 0–50 | 3 |
| Propylene | 0–100 | 1–80 | 5 |
| n-butane | 0–20 | 0–10 | 0.5 |
| i-butane | 0–60 | 0–30 | 1 |
| butylenes | 0–100 | 1–80 | 0.5 |

This stream containing propylene and ethylene may be upgraded as recovered. Optionally, it may be diluted with inert gas such as steam or nitrogen.

The so formed charge stream may be admitted to the stripper portion of the FCCU at 212°–1200° F., preferably 800°–1050° F., say 980° F. and pressure of 1–150 psig, preferably 10–50 psig, say 25 psig and weight hourly space velocity (WHSV) of 0.001–1000, preferably 0.01–50, say 5 parts by weight of olefin per part by weight of catalyst in the stripper at any instant per hour and catalyst to olefin ratio of 0.1–5000, preferably 1–500, say 100 pounds of spent FCC catalyst being circulated to the stripper for every pound of oligomerizable olefin being fed into the stripper.

The upgrading process involves a series of reactions consisting of oligomerization, isomerization, cracking and hydrogen transfer. Taking propylene feed as an example:

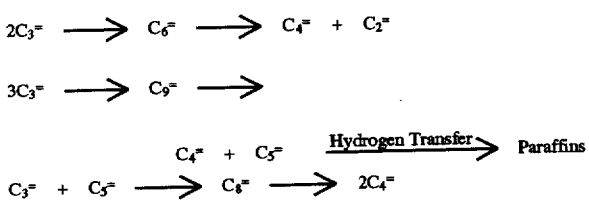

In the light of this, the present invention uses the spent FCC catalysts, optionally containing spent FCC additives, in the reactor/stripper part of the FCCU to upgrade $C_2$ to $C_8$ oligomerizable olefins, preferably propylene and ethylene, into $C_4/C_5$ olefins and isoparaffins as well as gasoline. Examples of feedstocks that can be upgraded by this process are product streams of the FCCU containing propylene and ethylene such as the absorber and depropanizer overheads. The feed stream to be upgraded can be introduced into the FCCU's stripper, replacing part or all of the stripping gas such as steam. Some FCCU's have multiple steam injection points. The feed stream can be injected into any steam injection point on the stripper, for instance, the upper or bottom or both ring of a two-ring injection stripper or into the single steam injection point if only one steam injection point exists. The spent FCC catalysts/additives from gas oil catalytic cracking further catalyze the olefin upgrading reactions under typical operating conditions in the FCCU's stripper and reactor and are then circulated to the FCCU's regenerator without interrupting the FCCU operation. Products from the olefin upgrading process are mixed with the FCC products, and the combined reactor effluent is separated as conventional FCCU product streams. Consequently, the overall yield of butenes, pentenes, isobutane as well as gasoline from the FCCU can be enhanced. No additional catalyst or reactor other than those already available in typical FCCU operations is needed.

The temperature in the reactor/stripper when the oligomerizable olefins are introduced should be in the range of 212° F. to 1200° F. The preferred range is 800° F.–1050° F.

The pressure may be in the range of 1 to 150 psig. The preferred range is 10 to 50 psig.

Practice of the process of this invention will be apparent to those skilled in the art from the following description of specific embodiments wherein all parts are parts by weight unless otherwise stated.

In addition to enhanced yields of alkylate/ether precursors and gasoline the instant invention offers other benefits which would be commercially advantageous. First of all, the olefin containing stream may have higher efficiency than steam in stripping hydrocarbons. Secondly, adding the olefin stream to the stripper may have a quenching effect in the reactor. Under usual conditions, there is often a secondary thermal cracking reaction going on at the point where the hot catalyst separates from the riser effluent hydrocarbon, resulting in some undesirable products. This would be reduced due to the quenching effect.

Examples 1–3 demonstrate that spent FCC catalysts are able to convert oligomerizable olefins into $C_4/C_5$ olefins and isoparaffins as well as gasoline, although spent catalysts are not as active as regenerated catalysts. On the other hand, a substantial amount of spent FCC catalysts are located in the reactor/stripper portion of FCCU at any instant of routine FCCU operation, being separated, stripped and then circulated to the regenerator. Taking full advantage of the residual catalytic activity of this massive bed of spent catalyst to upgrade olefins, e.g. propylene and ethylene, can result in a significant yield of isobutane, butenes, pentenes and gasoline.

EXAMPLE 1

Olefin Upgrading Using Spent FCC Catalysts

A regenerated equilibrium FCC catalyst containing REUSY (properties shown in Table 1) was first used to perform microactivity testing (FCC-MAT) on a gas oil sample (properties shown in Table 2) under the following conditions:

| | | |
|---|---|---|
| Temperature | = | 960° F. |
| Catalyst | = | 4 g |
| Feed injection time | = | 23 sec |
| WHSV | = | 32 $h^{-1}$ |
| Cat/Oil | = | 5 |

The spent catalyst samples recovered from FCC-MAT runs were then used for the olefin upgrading process.

Seven grams of the spent FCC catalyst were loaded into a stainless steel tube reactor between two layers of quartz wool. Prior to reaction, the catalyst sample was dried in flowing nitrogen for 2 hours. The reaction was carried out by introducing a gas mixture of 5 mol % propylene and 95 mol % nitrogen (10 ml/min) into the reactor for 5 minutes, followed by another 10 minutes of nitrogen purging. The following conditions were used:

| | | |
|---|---|---|
| Temperature | = | 752° F. |
| Catalyst | = | 7 g |
| Pressure | = | near atmospheric |
| WHSV | = | 0.007 g $C_3^=$/g cat/hr |

Table 4 reports that about 20% propylene conversion was achieved by the spent FCC catalyst sample. The selectivity toward upgraded products, i.e., isobutane, butenes, isopentane, gasoline, was over 50%.

Control experiments using an empty reactor showed negligible conversion of propylene under the same conditions.

EXAMPLE 2

Olefin Upgrading Using Spent FCC Catalysts Containing Additives

In this example, the regenerated FCC equilibrium catalyst used in Example 1 was blended with 5 wt % of commercially available ZSM-5 FCC additive. The mixture was then used for the FCC-MAT testing. The retrieved spent catalyst was tested for propylene upgrading under the same conditions as described in Example 1. Results shown in Table 5 indicate that in the presence of the commonly used ZSM-5 FCC additive, spent catalysts from catalytic cracking of gas oil are also able to catalyze olefin upgrading reactions.

EXAMPLE 3

Process of Olefin Upgrading Using the Spent FCC Catalysts in FCCU's Reactor/Stripper This example illustrates how the process of this invention may be utilized in conjunction with a fluid catalytic cracking unit. In the process embodied in FIG. 1, FCCU feedstock in line 4 is admitted to the riser of the FCCU (segment 5) to which regenerated catalyst is admitted through line 3. Catalytic cracking of FCCU feedstock takes place in the riser, and catalyst and hydrocarbon product are separated in reactor/stripper (block 1). The stream containing olefins (preferably propylene and ethylene) to be upgraded is introduced into the stripper portion of the FCCU through line 10. Supplemental stripping steam can be added from line 11. The olefin upgrading process is catalyzed by the spent FCC catalyst in the reactor/stripper, while the catalyst is also being stripped. The products from catalytic cracking of gas oil in the riser and from olefin upgrading in the reactor/stripper are combined into line 9 and then sent to be handled by typical FCCU separation operations. Spent catalysts from catalytic cracking followed by olefin upgrading are circulated through line 6 to the regenerator (block 2) where air is admitted through line 7 and flue gas is withdrawn through line 8.

TABLE 4

Propylene Upgrading Performance of Spent FCC Equilibrium Catalyst

| | |
|---|---|
| Run # | 356 |
| Catalyst | Spent FCC Catalyst |
| Mol % $C_3^=$ in Feed | 5% |
| Balance in Feed | $N_2$ |
| Temp., °F. | 752 |
| WHSV, g $C_3^=$/g cat/hr | 0.007 |
| $C_3^=$ wt % Conv. | 18.50 |
| $iC_4$ wt % Selectivity | 18.81 |
| $nC_4^=$ wt % Selectivity | 10.00 |
| $iC_4^=$ wt % Selectivity | 7.19 |
| $C_5^=$ wt % Selectivity | trace |
| $iC_5$ wt % Selectivity | 4.32 |
| Gasoline Selectivity | 10.76 |
| Selectivity to Upgraded Products | 51.08 |
| Yield to Upgraded Products | 9.45 |

TABLE 5

Propylene Upgrading Performance of Spent FCC Equilibrium Catalyst Containing 5 wt % Spent Commercially Available ZSM-5 FCC Additive

| | |
|---|---|
| Run # | 358 |
| Catalyst | Spent FCC Catalyst with 5 wt % Additive |
| Mole % $C_3^=$ | 5% |
| Temp, °F. | 752 |
| WHSV, g $C_3^=$/g cat/hr | 0.007 |
| $C_3^=$ | 58.80 |
| $iC_4$ wt % selectivity | 5.98 |
| $nC_4^=$ wt % Selectivity | 5.17 |
| $iC_4^=$ wt % Selectivity | 3.94 |
| $C_5^=$ wt % selectivity | 0.58 |
| $iC_5$ wt % Selectivity | 1.36 |
| Gasoline Selectivity | 3.64 |
| Selectivity to Upgrade Products | 20.67 |
| Yield to Upgrade Products | 12.15 |

What is claimed is:

1. A fluid catalytic cracking process for cracking a fluid catalytic cracking feedstock and for upgrading a separate feedstock containing olefins selected from the group consisting of $C_2$ to $C_8$ olefins and including at least $C_2$ and $C_3$ olefins to increase the overall yield of $C_4$–$C_5$ olefins and isoparaffins in the fluid catalytic cracking product comprising the steps of:

a. charging a fluid catalytic cracking feedstock into the riser reactor of a fluid catalytic cracking process;

b. charging regenerated fluid catalytic cracking catalyst into said riser reactor;

c. reacting said fluid catalytic cracking feedstock in the presence of said regenerated catalyst in said riser reactor to produce a hydrocarbon effluent and spent catalyst;

d. introducing said hydrocarbon effluent and said spent catalyst into the reactor/stripper of said fluid catalytic cracking process;

e. separating said hydrocarbon effluent and said spent catalyst in said reactor/stripper;

f. charging said separate feedstock containing said olefins to be upgraded to said reactor/stripper;

g. reacting said olefins in the presence of said spent catalyst to oligomerize at least some of said olefins and produce an upgraded olefin product containing additional $C_4$ and $C_5$ olefins and isoparaffins;

h. simultaneously stripping said spent catalyst at least in part with said separate feedstock;

i. combining said separated hydrocarbon effluent and said upgraded olefin product to form a combined fluid catalytic product; and j. removing said spent catalyst from said reactor/stripper and regenerating said spent catalyst.

2. The process of claim 1 wherein the catalyst in the riser reactor comprises zeolites selected from the group consisting of Y zeolite, beta zeolite, L zeolite, X zeolite, MCM-22, MCM-41, ZSM-5, ZSM-11, SAPO-5, SAPO-11, SAPO-37, and their structural analogy with framework substitution by elements other than aluminum and silicon.

3. The process of claim 2 wherein the Y-zeolite is a Y-zeolite selected from the group consisting of Rare-Earth Y (REY), dealuminated Y (DAY), Ultrastable Y (USY), and Rare-Earth containing Ultrastable Y (RE-USY).

4. The process of claim 1 wherein the temperature in the reactor/stripper is in the range of 212° F. to 1200° F.

5. The process of claim 4 wherein the temperature in the reactor/stripper is in the range of 800° F. to 1050° F.

6. The process of claim 5 wherein the temperature in the reactor/stripper is in the range of 900° F. to 1000° F.

7. The process of claim 1 wherein the pressure is from about 1 psig to 150 psig.

8. The process of claim 1 wherein said olefins to be upgraded are from product streams of the FCCU containing propylene and ethylene selected from the absorber and depropanizer overheads.

9. The process of claim 1 and further including the step of charging stripping steam to said reactor/stripper in addition to said separate feedstock.

10. The process of claim 1 wherein said fluid catalytic cracking feedstock is selected from the group consisting of naphtha, kerosene, diesel oil, gas oil, vacuum gas oil and mixtures thereof.

* * * * *